US006511386B1

(12) United States Patent
Cacicedo

(10) Patent No.: US 6,511,386 B1
(45) Date of Patent: Jan. 28, 2003

(54) HAND GRIP ATTACHMENT WITH MECHANICAL MEANS FOR ADJUSTING FIRMNESS AND FEEL

(75) Inventor: Paulino Cacicedo, Scotch Plains, NJ (US)

(73) Assignee: D.B. Consolidated Enterprises, Inc., Roselle Park, NY (US)

( * ) Notice: Subject to any disclaimer, the term of this patent is extended or adjusted under 35 U.S.C. 154(b) by 0 days.

(21) Appl. No.: 09/947,575

(22) Filed: Sep. 6, 2001

(51) Int. Cl.[7] ..... A63B 53/16

(52) U.S. Cl. ..... 473/300; 473/568; 473/549; 81/492; 81/490

(58) Field of Search ..... 473/300–303, 473/568, 549; D21/756; D8/DIG. 6–8; 74/551.9; 81/489, 492, 490; 16/DIG. 18, DIG. 19, DIG. 12

(56) References Cited

U.S. PATENT DOCUMENTS 4,629,191 A * 12/1986 Mancuso ..... 473/203
4,738,166 A * 4/1988 Yamaguchi ..... 81/22
4,924,733 A * 5/1990 McKenzie ..... 81/177.4
5,490,437 A * 2/1996 Hebert et al. ..... 81/22
5,653,643 A * 8/1997 Falone et al. ..... 473/300
5,730,669 A 3/1998 Huang ..... 473/549
5,910,054 A 6/1999 Huang ..... 473/302
5,926,911 A * 7/1999 Chen ..... 16/111.1
6,004,224 A * 12/1999 Tanaka ..... 473/297
6,042,485 A * 3/2000 Cheng ..... 473/318
6,223,627 B1 * 5/2001 Jan et al. ..... 81/22

FOREIGN PATENT DOCUMENTS

GB 461562 * 12/1937

* cited by examiner

*Primary Examiner*—Stephen Blau
(74) *Attorney, Agent, or Firm*—Lerner, David, Littenberg, Krumholz & Mentlik, LLP

(57) ABSTRACT

A hand grip attachment has, a generally cylindrical member with an enhanced gripping surface on the exterior surface and an inner surface defining a mounting bore extending end to end through the cylindrical member to enable the hand grip attachment to be mounted on the handle end of a piece of sporting equipment, a wall of selected thickness is formed between the exterior surface and the interior surface and at least one or more elongated bores are formed in said wall for operative coaction with a filler such as hollow or solid stiffening rods made of any suitable material to establish the firmness and feel of the hand grip attachment.

25 Claims, 4 Drawing Sheets

HAND GRIP ATTACHMENT WITH MECHANICAL MEANS FOR ADJUSTING FIRMNESS AND FEEL

BACKGROUND OF THE INVENTION

This invention relates generally to hand grip attachments for sporting equipment having handles or shafts with hand grips thereon and more particularly to hand grips for attachment to hand-operated sporting equipment members in which the hand grip attachment has mechanical means for adjusting the firmness and feel of such hand-operated members and may be affixed as original equipment by the manufacturer of such sporting equipment or may serve as a repair or replacement member by the owner or user of such hand-operated member.

In sporting goods and equipment which are hand operated, such as the racquets used in tennis, racket ball and squash or golf clubs, the handles or shafts often have improved hand grips applied for various reasons, such as reducing the shock generated during impact and use of these sporting goods or equipment and for improving the gripping quality for such handles or shafts.

The hand grip of the present invention provides a relatively simple mechanical means for adjusting the firmness and feel for such handles, and although the embodiments are illustrated with respect to improving the hand grip end for golf club shafts, those skilled in the art will recognize that this is only by way of illustration and that the present invention is also applicable to handles and shafts for other types of sporting goods and equipment such as racquets, baseball bats, or even tools such as hammers, without departing from the scope of the present invention. These advantages and other features of the present invention will become apparent from the following detailed description, when taken in conjunction with the accompanying drawings.

SUMMARY OF THE INVENTION

Accordingly, in one aspect the present invention provides a hand grip attachment for a handle-operated member having a generally elongated cylindrical member with an exterior surface, an interior surface defining a handle receiving space extending end to end therethrough and opening at opposite ends of the cylindrical member to enable the cylindrical member to be mounted about the handle end of the handle-operated member, said cylindrical member has a wall between the exterior surface and the interior surface having a predetermined thickness, at least one bore formed in the wall of the cylindrical member, and at least one filler means mounted in each said at least one bore for adjusting the firmness and feel of the hand grip attachment in assembled position.

It is another aspect of the present invention to provide a hand grip attachment for the handle end of sporting equipment having a generally cylindrical member which is circular in cross-section having an exterior surface and an interior surface defining a handle receiving space to enable the handle attachment to be mounted about the handle end of the sporting equipment, said exterior surface and interior surface defining a wall on said cylindrical member of predetermined thickness, a plurality of longitudinally extending bores in said wall, and a sized and shaped rod or filler member made of a predetermined material removably mounted in each of said plurality of bores to adjust the firmness and feel of the hand grip attachment in assembled position.

It is another aspect of the present invention to provide a hand grip attachment for the handle end of sporting equipment having a generally cylindrical member which is circular in cross-section, having an upper end, a lower end, an exterior surface and an interior surface defining a handle receiving space extending end to end therethrough and open at the upper end and lower end of the cylindrical member to enable the hand grip attachment to be mounted about the handle end of the sporting equipment, a wall formed on said cylindrical member between said exterior surface and interior surface of predetermined thickness, a plurality of longitudinally extending bores in said wall, and a sized and shaped filler member made of a predetermined material removably mounted in each of said plurality of bores to adjust the firmness and feel of the hand grip attachment in assembled position.

It is another aspect of the present invention to provide a hand grip attachment for the handle end of sporting equipment having a generally cylindrical member which is circular in cross-section, having an upper end, a lower end, an exterior surface and an interior surface defining a handle receiving space extending end to end therethrough and open at the upper end and lower end of the cylindrical member to enable the hand grip attachment to be mounted about the handle end of the sporting equipment, a wall formed on said cylindrical member between said exterior surface and interior surface of predetermined thickness, a plurality of longitudinally extending bores in said wall, a sized and shaped rod or filler member made of a predetermined material removably mounted in each of said plurality of bores to adjust the firmness and feel of the hand grip attachment in assembled position, and a cap member removably mounted in said opening formed at the upper end of the cylindrical member the hold the rod members in assembled position and to enable the rod members to be removed and replaced for adjusting the firmness and feel of the hand grip attachment in assembled position.

It is another aspect of the present invention to provide a hand grip attachment for the handle end of sporting equipment having a generally cylindrical member which is oval in cross-section, having an upper end, a lower end, an exterior surface and an interior surface defining a handle receiving space extending end to end therethrough and open at the upper end and lower end of the cylindrical member to enable the hand grip attachment to be mounted about the handle end of the sporting equipment, a shaped wall of predetermined thickness formed on said cylindrical member offset from said inner surface, at least one bore in said wall, and a filler member made of a predetermined material removably mounted in each said at least one bore to adjust the firmness and feel of the hand grip attachment in assembled position.

It is another aspect of the present invention to provide a hand grip attachment for the handle end of sporting equipment having a generally cylindrical member which is oval in cross-section having, an upper end, a lower end, an exterior surface and an interior surface defining a handle receiving space extending end to end therethrough and open at the upper end and lower end of the cylindrical member to enable the hand grip attachment to be mounted about the handle end of the sporting equipment, a shaped wall of predetermined thickness formed on said cylindrical member offset from said interior surface, a plurality of elongated bores in said wall, and a shaped and sized filler member made of a predetermined material removably mounted in each of said plurality of elongated bores to adjust the firmness and feel of the hand grip attachment in assembled position.

It is another aspect of the present invention to provide a hand grip attachment for the handle end of sporting equipment having a generally cylindrical member which is oval in cross-section, having an upper end, a lower end, an exterior surface and an interior surface defining a handle receiving space extending end to end therethrough and open at the upper end and lower end of the cylindrical member to enable the handle attachment to be mounted about the handle end of the sporting equipment, a shaped wall of predetermined thickness formed on said cylindrical member offset from said interior surface, at least one bore in said wall, a filler member made of a predetermined material removably mounted in each said at least one bore to adjust the firmness and feel of the hand grip attachment in assembled position, and an end cap removably connected in the upper open end of the cylindrical member to hold each filler member in assembled position and to enable each filler member to be removed and replaced as may be required to adjust the firmness and feel of the hand grip attachment in assembled position.

It is another aspect of the present invention to provide a hand grip attachment for the handle end of sporting equipment, having a generally elongated shaped member with an exterior surface, an interior surface defining a handle receiving space extending end to end through and opening at opposite ends of the cylindrical member to enable the cylindrical member to be mounted about the handle end of the sporting equipment, and the exterior surface of the cylindrical member having spaced annular ridges and alternately spaced circumferential projections therebetween to provide better hand engagement of the hand grip attachment in assembled position.

DETAILED DESCRIPTION

Figure 1:
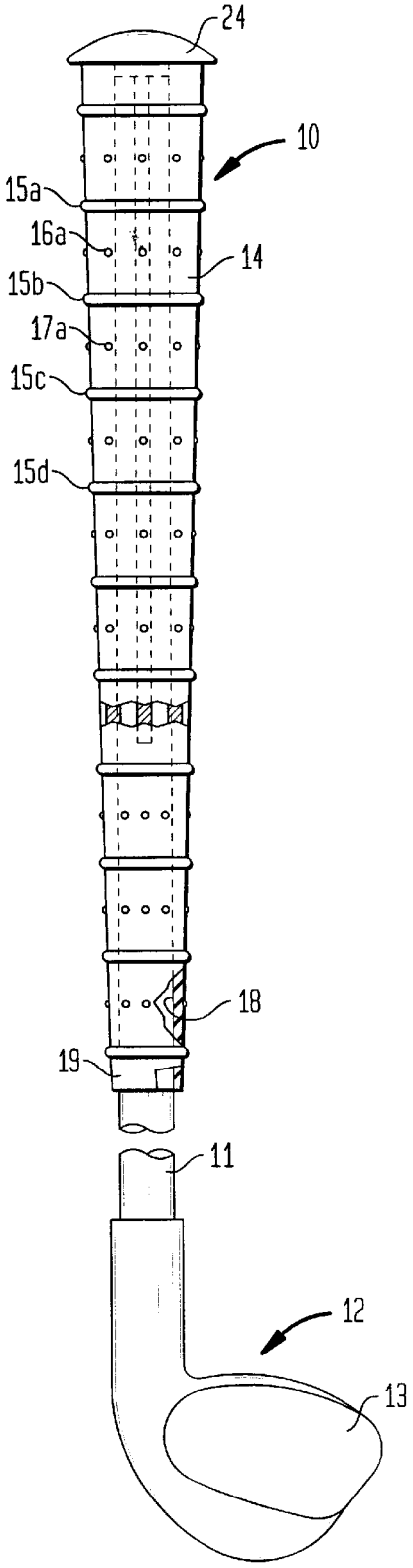
FIG. 1 is a foreshortened front view partly in vertical section of the handle end of a golf club having one embodiment of the hand grip attachment thereon, in accordance with the present invention.

Referring to the drawings, FIG. 1 shows one embodiment of the hand grip attachment generally designated 10 in accordance with the present invention mounted or affixed to the handle end of a foreshortened length of a golf club shaft 11 for a golf club 12 having a golf club head 13 at the end of the golf club shaft remote from the handle end. Golf clubs are well known types of sporting equipment to which a hand grip attachment is applied to enhance gripping and use of the golf club. Accordingly, those skilled in the art will recognize that the description of the hand grip attachment as applied and used on the handle end of a golf club shaft is for the purpose of illustrating the present invention and not by way of limitation.

Figure 2:
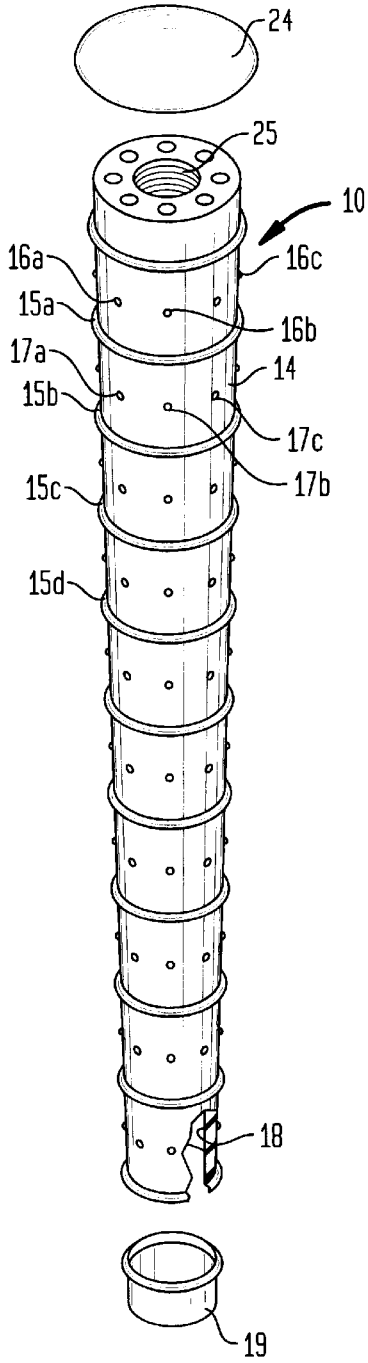
FIG. 2 is an exploded perspective view also partly in vertical section of the embodiment of the hand grip attachment shown in FIG. 1 with the handle end of the golf club shaft removed.
Figure 3:
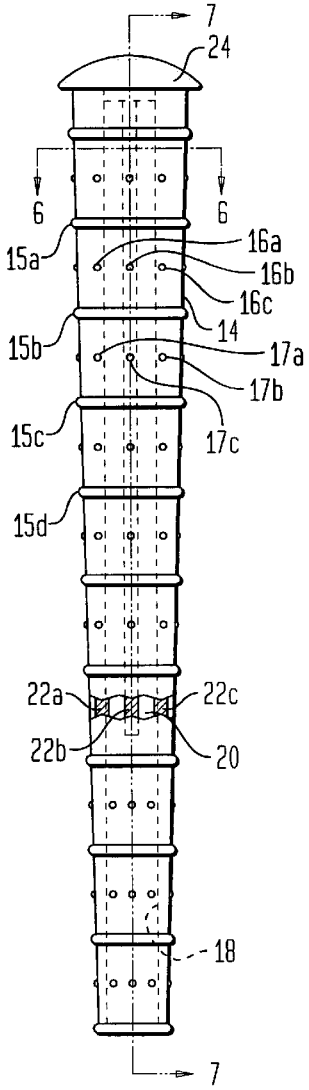
FIG. 3 is a side view of the embodiment of the hand grip attachment shown in FIG. 2.
Figure 4:
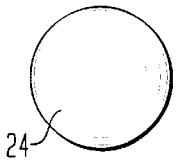
FIG. 4 is a top view of the embodiment of the hand grip attachment shown in FIG. 2.
Figure 5:
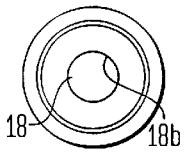
FIG. 5 is a bottom view of the embodiment of the hand grip attachment shown in FIG. 2.
Figure 6:
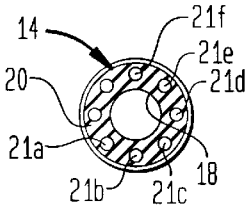
FIG. 6 is a transverse section taken on line 6—6 of FIG. 3.

Hand grip attachment 10 is an elongated cylindrical member 14, having an exterior or outer surface and an interior or inner surface and made of a pliable and resilient material such as polyurethane, polyethylene, natural or synthetic rubbers such as styrenebutadiene, neoprene, butyl rubber and the like. In this illustrated embodiment of the invention, cylindrical member 14 is generally circular in transverse section at both the upper end and the lower end and forms a generally tapered cone shape being wider at the upper end and narrower at the lower end. Those skilled in the art will also recognize that, while the transverse shape is shown as generally circular, the transverse cross-sectional shape may also be square, rectangular, octagon or irregular, as will be clear from the further embodiment of the invention as is shown in the drawings and hereinafter more fully described. Further, cylindrical member 14 has a length as a function of the space necessary to accommodate the hands of a user of a golf club with the hand grip attachment 10 thereon. Thus the cylindrical member 14 of the hand grip attachment 10 may have a length in a range from 8 to 11 inches and preferably about 10 inches, a length which accommodates the average hand size of users of such hand grip attachments. Similarly, the diameter of the cylindrical member 14 will be in a range from ¾ to 1½ inches and preferably for average hand sizes about 1 inch, all as generally shown by FIGS. 1, 2 and 3 of the drawings.

FIGS. 1, 2, 3, 6 and 7 show that in this embodiment of the present invention, the exterior or outer surface of the cylindrical member 14 has spaced annular ridges 15*a*, 15*b*, 15*c*, 15*d*, etc. which extend and are spaced along the longitudinal line of the exterior surface of cylindrical member 14. Interspersed between each pair of the spaced annular ridges are a plurality of circumferentially disposed projections or bumps as at 16*a*, 16*b*, 16*c*, etc and 17*a*, 17*b*, 17*c*, etc. The spaced annular ridges and circumferentially disposed projections or bumps are designed to enhance the gripping engagement of the hands when the hand grip attachment 10 is connected into assembled position on the handle end of the golf club shaft.

The interior or inner surface of cylindrical member 14 defines a mounting bore or space 18 which extends end to end along the longitudinal line of the cylindrical member 14 forming an upper end opening 18*a* and a lower end opening 18*b* to enable the hand grip attachment 10 to be connected into assembled position on the handle end of the golf club shaft 11, as shown in FIG. 1. For this purpose the inner diameter of the mounting bore 18 will be sized depending on how it will be affixed to the exterior of the handle end of the golf club shaft 11. Thus the inner diameter of the opening 18 nay be sized to provide a friction fit to enable the hand grip attachment 10 to be removably mounted in assembled position on the handle end of the golf club shaft 11, or the inner diameter of the opening or mounting bore 18 can be sized to be adhesively affixed so that it cannot be easily removed from the golf club shaft or, if removed, may be so damaged that it can no longer be replaced into assembled position. Another technique for affixing or connecting the hand grip attachment 10 into assembled position is to provide an annular ferrule 19 as shown at FIGS. 1 and 2. In this arrangement the annular ferrule 19 is affixed at a predetermined distance from the upper end of the golf club shaft 11, and the hand grip attachment 10 can be mounted over the upper end of the golf club shaft 11 and brought into engagement and held in assembled position by the ferrule 19.

In order to achieve one of the main advantages of the present invention, the cylindrical member 14 must be molded, cast or fabricated to establish a wall 20, having a predetermined thickness, between the exterior surface having the annular ridges and circumferential protuberances and the interior surface defining the opening or mounting bore 18. Wall 20 follows the generally tapered cone shape of the cylindrical member 14 and extends longitudinally along the length thereof from the wider upper end to the narrower lower end of the hand grip attachment 10. The selected thickness of the wall 20 must be adequate to enable a plurality of circumferentially spaced and sized elongated bores 21*a*, 21*b*, 21*c* and 21*d*, etc. to be formed, cast or otherwise fabricated in and along the longitudinal line of the wall 20. The length of the elongated bores depends on the length where the wall 20 has adequate thickness, to maintain the integrity of the elongated bores, without piercing the side of the cylindrical member 14, all of which is shown in FIGS. 2, 3, 6 and 7 of the drawings for this embodiment of the invention.

In the embodiment of the invention illustrated at FIGS. 1 to 9 of the drawings, the cylindrical member 14 is shown as having eight elongated generally circular bores 21*a*, 21*b*, 21*c*, 21*d*, 21*e* and 21*f*, etc. which are sized so that they can be circumferentially spaced at 45° arcuate intervals. It has been found that this can be achieved for the average size cylindrical member as above described where the inner diameter of the respective elongated bores 21*a*, 21*b*, 21*c*, 21*d*, etc. is 3/16ths of an inch. This diameter enables the elongated bores to coact with filler members or filler means such as stiffening rods as at 22*a*, 22*b*, 22 and 22*f*, etc., which are inserted into the elongated bores 21*a*, 21*b*, 21*c* and 21*f*, etc. as is hereinafter described. Further, however, while in this embodiment of the invention the elongated bores are shown as uniformly circular and having the same diameters, this is not by way of limitation because the elongated bores can have other than circular shapes such as square, triangular, oval, etc. and can be spaced other than at uniform intervals and can have varying diameters depending on the desired variations in firmness and feel needed for a hand grip attachment to be used on the handle end of a golf club shaft, the handle end of a particular piece of sporting equipment or any handle-operated member.

Filler member or filler means, when used herein, is intended not only to mean the hollow or solid stiffening rods illustrated, but any type of filler member or filler materials that can be inserted or can fill the elongated bores 21*a*, 21*b*, 21*c*, 21*d* and 21*f*, etc. Thus, for example, instead of the stiffening rod-like members as illustrated in the embodiments of the invention shown in the drawings, the filler material could be a particulate material such as sand or a fluid material which forms into a gel, without departing from the scope of the present invention.

One form of the coacting filler members or filler means may be stiffening rods 22*a*, 22*b*, 22*c*, 22*d*, etc. The stiffening rods are elongated rod-like devices as at 22*b* which are solid members and can be made of any desired materials including at least paper, cardboard, plastic such as polyethylene, fiberglass, metal and natural or synthetic rubbers. For example, a solid fiberglass rod or any of the other types of materials, respectively having a diameter of about 1/8 inch, can be easily inserted into assembled position through an associated one of each of the end openings as at 23*b* for elongated bore 21*b* and 23*f* for elongated bore 21*f* located at the upper end of cylindrical member 14 or the like end openings for any one or more of the elongated bores 21*a*, 21*b*, 21*c*, 21*d*, 21*e* and 21*f*, etc. until the desired firmness and feel for the hand grip attachment 10 on the handle end of the golf club shaft 11, the handle end of a piece of sporting equipment or other handle-operated member is obtained, all of which is shown by FIGS. 2, 3, 6, 7 and 8 of the drawings.

Figure 7:
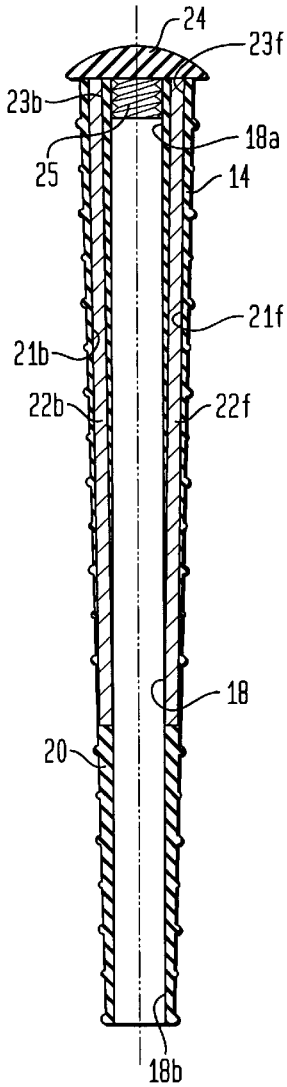
FIG. 7 is a longitudinal cross-section taken on line 7—7 of FIG. 3.
Figure 8:
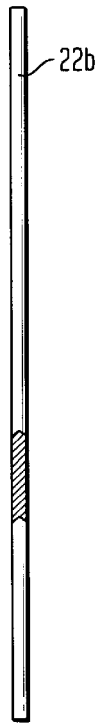
FIG. 8 is a side view of one form of stiffening rod for insertion into the hand grip attachment shown at FIGS. 2 and 3.
Figure 9:
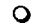
FIG. 9 is an end view of the stiffening rod shown in FIG. 8.

FIGS. 2 and 7 also show that an end cap or cover 24 can be removably connected by threaded or other means 25 in the upper end opening 18*a* in the cylindrical member 14 of hand grip attachment 10. Thus, if the user of the golf club desires to modify the firmness or feel of the hand grip attachment 10, they can do so by removing the end cap or cover 24 and remove or insert more or less or different types of stiffening rods or filler members to achieve this change and that this can be done as often as may be necessary for the hand grip attachment 10 on the golf club shaft 11, the handle end of any given piece of sporting equipment or any handle-operated member using such hand grip attachment in accordance with the present invention.

Referring further to the drawings, FIGS. 10 to 19 show another embodiment of the hand grip attachment in accordance with the present invention generally designated 110 also adapted to be mounted on the handle end of a golf club shaft, not shown, in the same manner shown and above described for the form of the invention at FIGS. 1 to 9 of the drawings. Those skilled in the art will again recognize that, while the hand grip attachment 110 is indicated as adapted to be affixed to the handle end of a golf club shaft, this is only for purposes of illustration and not by way of limitation and that the embodiment of the invention shown in FIGS. 10 to 19 is equally adapted for the handle end of other pieces of sporting equipment such as tennis, racket ball and squash rackets, baseball bats, etc. without departing form the scope of the present invention.

Hand grip attachment 110 is an elongated cylindrical member 114 having a generally oversized inverted oval shape in transverse cross-section, wider at the front than the back and tapering from the wider upper end to a generally narrower circular in transverse cross-section lower end. Cylindrical member 114 has an exterior or outer surface and an interior or inner surface and is also formed from a pliable and resilient natural or synthetic material such leather, polyurethane foam, polyethylene and natural or synthetic rubbers and the like. Further, as in the earlier form of the invention first described, cylindrical member 114 has a length as a function of the space necessary to accommodate the hands of a user of the particular piece of sporting equipment having the hand grip attachment 114 thereon. In particular, the cylindrical member 114 can have a length preferably about 10 inches. The diameter of the circumferential dimensions of the cylindrical member will vary from the upper end to the lower end because of the inverted oval shape. Thus, at the upper end the transverse dimension of the cylindrical member 114 will be about 1 1/16th of an inch from front to back and about 7/8ths of an inch from side to side and will taper from the upper end to a width or diameter of about 5/8ths of an inch at the lower, generally circular, end of the cylindrical member to achieve the advantages and benefits of the present invention for adjusting and modifying the firmness and feel of the hand grip attachment when it is in assembled position and being used, all of which is shown in FIGS. 10, 12, 16 and 17 of the drawings.

Figure 11:
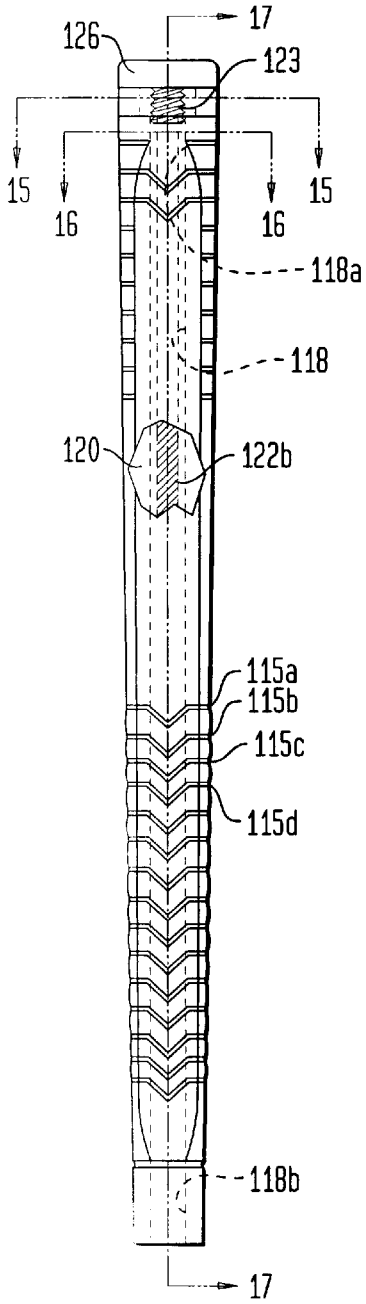
FIG. 11 is a front view of the embodiment of the hand grip attachment in accordance with the present invention shown in FIG. 10.
Figure 12:
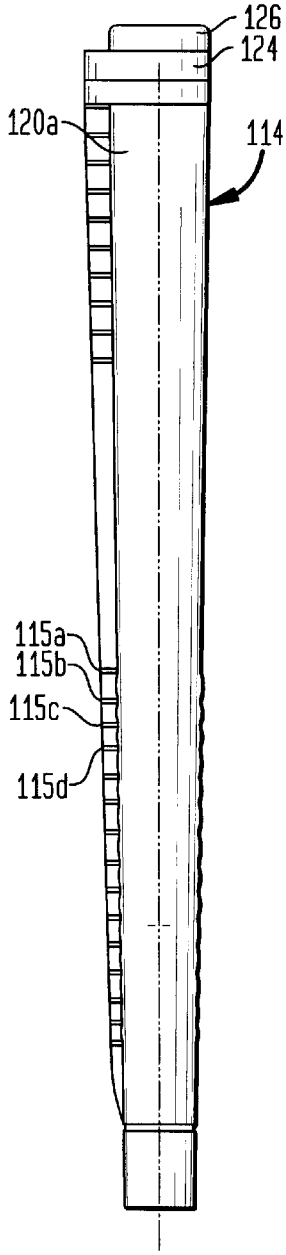
FIG. 12 is a side view of the embodiment of the hand grip attachment shown in FIG. 10.
Figure 13:
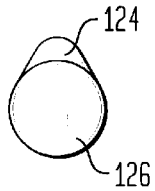
FIG. 13 is a top view of the embodiment of the hand grip attachment shown in FIG. 10.
Figure 14:
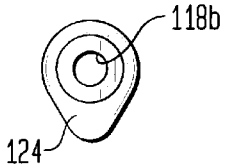
FIG. 14 is a bottom view of the embodiment of the hand grip attachment shown in FIG. 10.
Figure 15:
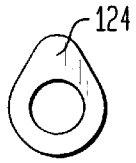
FIG. 15 is a transverse cross section taken on line 15—15 of FIG. 11.
Figure 16:
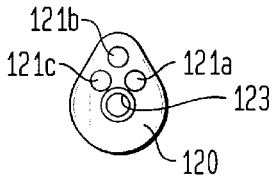
FIG. 16 is a transverse cross section taken on line 16—16 of FIG. 11.
Figure 17:
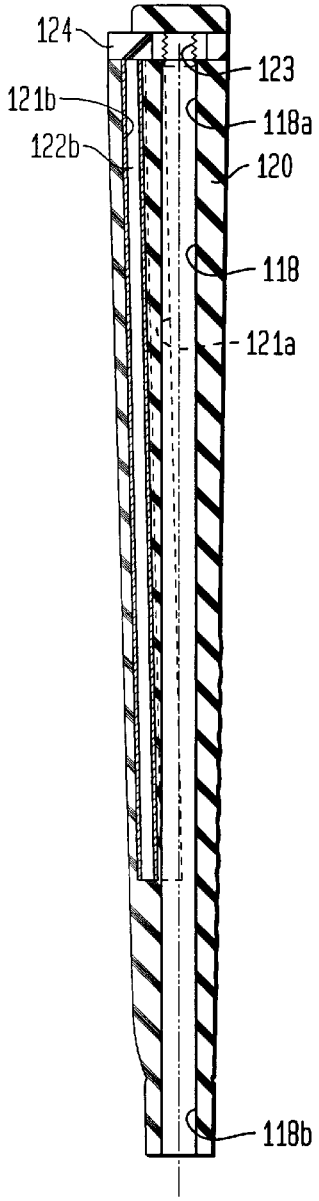
FIG. 17 is a longitudinal cross-section taken on line 17—17 of FIG. 11.

FIGS. 11 and 12 show that the exterior or outer surface of the cylindrical member 114 has a plurality of spaced circumferential irregular indentations or grooves as at 115*a*, 115*b*, 115*c*, 115*d*, etc. along the longitudinal length of the cylindrical member 114 of hand grip attachment 110 designed to enhance the gripping engagement of the hands when the hand grip attachment is mounted onto assembled position on the handle end of a golf club shaft, not shown, or the handle end of any other piece of sporting equipment.

Figure 10:
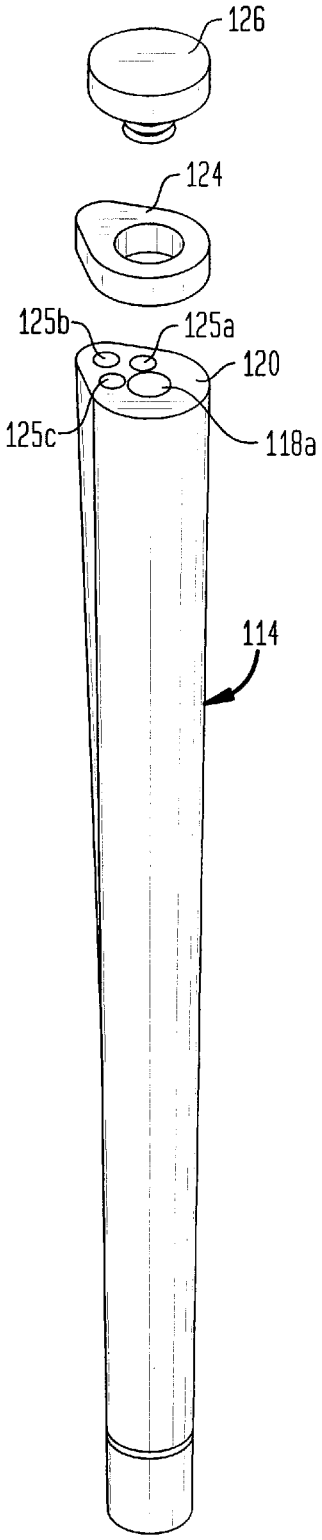
FIG. 10 is an exploded perspective view partly in vertical section of another embodiment of the hand grip attachment in accordance with the present invention.

The interior or inner surface of the cylindrical member 114 which defines the opening, mounting bore or space 118 extending end to end along the longitudinal line of the cylindrical member 114 to form am upper end opening 118*a* and lower end opening 118*b* for enabling the hand grip attachment 110 to be attached in assembled position on the handle end of the piece of sporting equipment, differs in position and location on the cylindrical member 114 from the centrally located position of the opening or mounting bore 18 as shown and earlier described for the form of the invention shown in FIGS. 1 to 9 of the drawings. Thus the opening or mounting bore 118 is disposed in the front section of the inverted oval shaped upper end and extends downwardly into the generally circular lower end of the cylindrical member 114. In effect, this positions the lesser or narrower back section 118*c* of the oval shaped upper end behind or to the side of the wider front section of the cylindrical member of the hand grip attachment 110, all of which is shown in FIGS. 10, 11 and 12 of the drawings.

Opening or mounting bore 118 will have a diameter such that it can be affixed by friction fit, adhesively or other suitable means to keep the hand grip attachment 110 in assembled position on the handle end of the operative piece of sporting equipment with which it is being used in the same manner as above described for the first form of the invention, all of which is shown by FIGS. 10, 14, 15 and 16 of the drawings.

The cylindrical member 114 must be molded, cast or fabricated to establish a wall 120 having a substantial part thereof of a predetermined thickness between the exterior or outer surface having the spaced indentations or grooves and the interior or inner surface defining the opening and mounting bore 118. Wall 120 follows the shape and contours of the cylindrical member 114 and extends downwardly along at least a portion of the length thereof. The width and thickness of at least part of the wall 120 will be such that at least three elongated longitudinally extending bores as at 121*a*, 121*b* and 121*c* can be molded, cast or fabricated in and along this part of the wall 120 to maintain the integrity of the bores so formed. The three elongated bores 121*a*, 121*b* and 121*c* are shown as generally circular in transverse cross-section and each will have a diameter of about 3/16ths of an inch which enable the elongated bores 121*a*, 121*b* and 121*c* to coact with stiffening rods 122*a*, 122*b* and 122*c* as hereinafter described. Although the elongated bores 121*a*, 121*b* and 121*c*and the coacting stiffening rods 122*a*, 122*b* and 122*c* are shown as generally round or circular and of a uniform diameters, those skilled in the art will recognize the elongated bores and their coacting stiffening rods can have different shapes and different diameters within the limitations of the thickness of the section of wall 120 in which the elongated bores are molded, cast or otherwise fabricated without departing from the scope of the present invention. The stiffening rods will be adjusted to match and/or adapt to changes in shape and diameter of the elongated bores.

Figure 18:
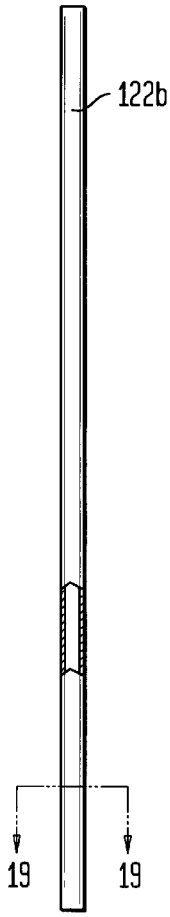
FIG. 18 is a side view of another form of the stiffening rod for insertion into the hand grip attachments in accordance with the present invention shown in FIGS. 2, 3, 10 and 11 of the drawings.
Figure 19:
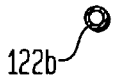
FIG. 19 is an enlarged end view of the stiffening rod shown in FIG. 18.

FIGS. 18 and 19 show another representative form of the stiffening rod 122*b* as an elongated hollow member which may be like a plastic straw, an aluminum tube or other material. The stiffening rod 122*b* and the other stiffening rods 122*a* and 122*c* will have an outer diameter of about 1/8th of an inch to enable the stiffening rod 122*a* to be inserted or replaced in any of the associated elongated bores 121*a*, 122*b* and 122*c*. Stiffening rod 122*b* is only representative of one form of the stiffening rod and can be made of any types of materials and can be solid as in the form of stiffening rod shown in FIGS. 8 and 9 of the drawings. This enables the user, by varying and changing the coacting stiffening rods inserted into the elongated bores, to adjust the hand grip attachment 110 to establish the desired firmness an feel for a given hand grip attachment when on assembled position on the handle end of a piece of sporting equipment, for example, a golf club shaft, handles on tennis, racket ball or squash rackets, baseball bats, and handles on lacrosse sticks.

At the upper end of the cylindrical member 114 in which upper end opening 118*a* is formed by the opening or mounting bore 118, a threaded insert as at 123 is provided about which a shaped retainer 124 is rotatably mounted to cover the elongated bore end openings 125*a*, 125*b* and 125*c* formed at the upper end 120*a* of the wall 120 of the cylindrical member 114 and to hold the stiffening rods 122*a*, 122*b* and 122*c* when inserted through the elongated bore end openings in assembled position in the elongated bores 121*a*, 122*b* and 122*c*. Further, a cap or cover member 126 is also removably threaded onto the threaded insert 123 to provide a finishing end and to retain all elements of the hand grip attachment 110 in assembled position after it is mounted or attached to the piece of sporting equipment.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A hand grip attachment for the handle end of a handle-operated member comprising:

a. a generally elongated cylindrical member having, an exterior surface, and an interior surface defining a handle receiving space extending end to end through the cylindrical member and forming an upper end opening at the upper end and a lower end opening at the lower end to enable the cylindrical member to be mounted to the handle end of the handle-operated member, b. said cylindrical member having a wall formed between the exterior surface and the interior surface, c. at least one bore formed in the wall of the cylindrical member open on at least one end for access thereto, and d. filler means adapted to be mounted in the at least one bore in the wall of the cylindrical member for adjusting the firmness and feel of the handle grip attachment when it is in assembled position on the handle of the sporting equipment.

2. In the hand grip attachment as in claim 1 wherein the opening for the bore is formed in the upper end of the cylindrical member, and closure means removably connected to the upper end of the elongated cylindrical member for holding the filler means in assembled position.

3. In the hand grip attachment as in claim 2 wherein the closure member is threadably mounted in the opening formed at the upper end of the handle receiving space in the elongated cylindrical member.

4. In the hand grip attachment as in claim 1 or 2 wherein the elongated cylindrical member is made from a pliable and resilient material from the group of natural and synthetic plastics such as polyurethane foams, polyethylene, and natural and synthetic rubbers such as styrenebutadiene, neoprene and butyl rubbers.

5. In the hand grip attachment as in claim 1 including, an annular member at the lower end of the handle grip attachment to engage and hold the handle grip attachment in assembled position on the handle end of the sporting equipment.

6. In the hand grip attachment as in claim 1 or 2 wherein the filler means is a solid stiffening rod.

7. In the hand grip attachment as in claim 1 or 2 wherein the filler means is a solid stiffening rod made of a material from the group of plastics, fiberglass or metals.

8. In the hand grip attachment as in claim 1 or 2 wherein the filler means is a hollow stiffening rod.

9. In the hand grip attachment as in claim 1 or 2 wherein the filler means is a hollow stiffening rod from the group consisting of a hollow straw, an aluminum tube, a plastic tube and a fiberglass tube.

10. In the hand grip attachment as in claim 1 or 2, having a length of about ten (10) inches.

11. The hand grip attachment as in claim 1 or 2 wherein the wall has a selected thickness to accommodate a plurality of elongated bores of approximately ⅜ths of an inch.

12. The hand grip attachment as in claim 1 or 2 wherein the cylindrical member is generally circular in cross-section and the wall has a selected thickness to accommodate a plurality of elongated bores spaced circumferentially at forty-five degree angles from each other, and each of said plurality of bores has a diameter of approximately ⅜ths of an inch.

13. The hand grip attachment as in claim 1 or 2 wherein the cylindrical member is generally oval in cross-section and wherein:

a. the mounting bore extends end to end therethrough; and b. the wall is offset from the mounting bore.

14. A hand grip attachment for the handle end of sporting equipment comprising:

a. a generally elongated cylindrical member made of a pliable and resilient material having, an upper end, a lower end, a tapered exterior wall and an interior wall defining a handle receiving space extending end-to-end through the cylindrical member, b. said handle receiving space forming an opening at the lower end of the cylindrical member to provide means for mounting the elongated cylindrical member to the handle end of the sporting equipment, c. the elongated cylindrical member having a predetermined wall thickness between the tapered exterior wall and the interior wall defining the handle receiving spaces, d. at least one bore formed in the wall of the cylindrical member open at the upper end of the cylindrical member and extending from the upper end through a portion of the length of the wall of the elongated cylindrical member, e. at least one sized elongated filler member adapted to be removably mounted in the at least one bore in the wall of the cylindrical member for adjusting the firmness and feel of the handle grip attachment when it is in assembled position on the handle of the sporting equipment, and f. closure means movably connected to the upper end of the elongated cylindrical member for holding the at least one filler member in assembled position.

15. In the hand grip attachment as in claim 14 wherein the pliable and resilient material of the elongated cylindrical member is from the group of natural and synthetic plastics such as polyurethane foams, polyethylene, and natural and synthetic rubbers such as styrenebutadiene, neoprene and butyl rubber.

16. In the hand grip attachment as in claim 15 including, an annular member at the lower end of the handle grip attachment to engage and hold the handle grip attachment in assembled position on the handle end of the sporting equipment.

17. In the hand grip attachment as in claim 14 wherein the closure means is threadably mounted in the opening formed by the upper end of the handle receiving space in the elongated cylindrical member.

18. In the hand grip attachment as in claim 14 or 15 wherein the filler means is a solid stiffening rod.

19. In the hand grip attachment as in claim 14 or 15 wherein the filler means is a solid stiffening rod made of a material from the group of plastics, fiberglass or metals.

20. In the hand grip attachment as in claim 14 or 15 wherein the filler means is a hollow stiffening rod.

21. In the hand grip attachment as in claim 14 or 15 wherein the filler means is a hollow stiffening rod from the group consisting of a hollow straw, an aluminum tube, a plastic tube and a fiberglass tube.

22. In the hand grip attachment as in claim 14 or 15, having a length of about 10 inches.

23. The hand grip attachment as in claim 14 or 15 wherein the wall has a selected thickness to accommodate a plurality of elongated bores of approximately ⅜ths of an inch.

24. The hand grip attachment as in claim 14 or 15 wherein the cylindrical member is generally circular in cross-section and the wall has a selected thickness to accommodate a plurality of elongated bores spaced circumferentially at forty-five degree angles from each other, and each of said plurality of bores has a diameter of approximately ⅜ths of an inch.

25. The hand grip attachment as in claim 14 or 15 wherein the cylindrical member is generally oval in cross-section and wherein:

a. the mounting bore extends end to end therethrough; and b. the wall is offset from the mounting bore.

* * * * *

UNITED STATES PATENT AND TRADEMARK OFFICE

CERTIFICATE OF CORRECTION

PATENT NO. : 6,511,386 B1 
DATED : January 28, 2003
INVENTOR(S) : Paulino Cacicedo It is certified that error appears in the above-identified patent and that said Letters Patent is hereby corrected as shown below:

Column 2,
Line 33, “the” should read -- to --.

Column 5,
Line 13, “nay” should read -- may --.

Column 9,
Line 9, delete “to be” and insert -- to fill and to be removably --.
Line 10, after “member” insert -- and being continuous from a top to a bottom end of said bore --.
Line 13, delete “sporting equipment” and insert -- hand-operated member --.
Line 25, delete “from the group”.
Line 26, delete “such as” and insert -- from the group of --.
Line 27, delete “such as” and insert -- from the group of --.

Column 10,
Line 15, “means” should read -- member --.
Line 15, after “adapted” insert -- to fill and --.
Line 17, after “member” insert -- and being continuous from a top to a bottom end of said bore --.
Line 26, delete “from the group”.
Line 27, delete “such as” and insert -- from the group of --.
Line 28, delete “such as” and insert -- from the group of --.

Signed and Sealed this

Fifth Day of August, 2003

JAMES E. ROGAN
*Director of the United States Patent and Trademark Office*